US006152220A

United States Patent [19]

Carmichael et al.

[11] Patent Number: 6,152,220

[45] Date of Patent: Nov. 28, 2000

[54] DOWN-HOLE TOOL WITH CENTRALISING COMPONENT

[75] Inventors: Mark Carmichael, Aboyne; Paul Howlett, Colts, both of United Kingdom

[73] Assignee: Specialised Petroleum Services Limited, Westhill, United Kingdom

[21] Appl. No.: 09/260,274

[22] Filed: Mar. 2, 1999

[30] Foreign Application Priority Data

Aug. 21, 1998 [GB] United Kingdom ..... 9818181

[51] Int. Cl.[7] ..... E21B 37/00

[52] U.S. Cl. ..... 166/173; 166/175; 166/241.7

[58] Field of Search ..... 166/170, 173, 166/175, 311, 241.7

[56] References Cited

U.S. PATENT DOCUMENTS

| | | | |
|---|---|---|---|
| 3,292,705 | 12/1966 | Hall | 166/173 |
| 3,292,708 | 12/1966 | Mundt | 166/173 |
| 3,762,472 | 10/1973 | Alexander | 166/173 X |
| 4,456,064 | 6/1984 | Ford | 166/173 |
| 4,984,633 | 1/1991 | Langer et al. | 166/173 X |
| 5,348,086 | 9/1994 | Trout | 166/173 X |
| 5,829,521 | 11/1998 | Brown | 166/173 |

*Primary Examiner*—Roger Schoeppel
*Attorney, Agent, or Firm*—Clifford W. Browning; Woodward, Emhardt, Naughton, Moriarty, & McNett

[57] ABSTRACT

A tool for use in a well bore has a housing attachable to a work string or drill string wherein the housing supports a floating component that is free to move in the lateral or radial members relative to the housing within predetermined limits. The floating component is suitable for supporting active tool components such as wire bristles, scraper blades or other functional apparatus. Typically, the floating component is provided as a sleeve around the housing held within axial limits, while enabling radial movement.

19 Claims, 8 Drawing Sheets

DOWN-HOLE TOOL WITH CENTRALISING COMPONENT

This invention relates to equipment intended for use in down-hole environments, such as may typically be found in oil and gas wells. The invention has a particular application in connection with well casing cleaning apparatus.

There are several operations performed down-hole where it is advantageous to centralise a tool or other component in the well bore, or more usually, within the well casing. Indeed, certain tools have been developed known as casing centralisers which are specifically designed to appropriately position a drill string in the casing so that a tool or sub attached to the string may work efficiently.

The need for centralising is particularly apparent in non vertical or horizontal wells, where the weight of the string tends to cause it to lie closer to the casing on its lower side than its upper side.

An example of the detrimental effect of this tendency may be found in respect of well clean up tools. Well clean-/up tools typically provide cleaning members which are radially biased by springs or the like against the walls of the casing string. However, when a tool is not located centrally within the casing, the radial pressure of the tool is uneven in consequence to the different degrees of extension of the springs or other biasing means.

The present invention recognises therefore that it would be advantageous to design a means for enabling certain tools, subs or tool components to be self centralising in a casing or other well tubing.

A further object of the invention is to provide an improved retaining means for retaining detachable components or consumables to the body of a respective down-hole tool.

The retaining means should allow for the convenient and efficient removal and replacement of a component or consumable, while also allowing for the effective use and operation of the component during the normal operation of the tool. As iterated above, such effectiveness is enhanced by the inherent ability of the component to be self centralising in a casing or other well tubing.

An example of the type of component that would be advantageous to retain in a detachable and centralised manner is a pad or plate or other component used to support cleaning members on casing clean up tools. Such cleaning members may, for example, be in the form of bristles as found in brush tools or scraper blades as found in casing scrapers.

A casing brush or brushing tool as it is also known in the industry is a type of well clean up tool, designed for producing a clean interior in the casing or liner of the drilling well. The tools typically support a bed of wire bristles on a detachable component that is biased outwardly by compression springs or the like that cause the bristles to bear forcibly on the casing wall.

In British Patent Application Number 2,299,599, there is described well cleaning apparatus which has a body member to which is attached, preferably, a plurality of cleaning pads spaced circumferentially around the body member. The pads are provided with bristles on their outer face and are biased outwardly by coil springs or similar means in an attempt to maintain a sufficient contact pressure of the bristles on the interior wall of the casing.

British Patent Number GB 2,295,632 describes an alternative brushing tool which incorporates bristles that protrude from raised rib-like portions on a body member.

An alternative well clean up tool is generally known as a casing scraper. This type of tool typically incorporates casing scraper blades that scrape the inside of the casing or tubing in the well. The steel blades may also be mounted on detachable pads, plates or the like.

A further object of the present invention is to provide an improved means of retaining pads supporting brushes, scraper blades or the like.

According to a first aspect of the present invention, there is provided a down-hole tool comprising a housing attachable to a work string or drill string, wherein the housing is adapted to support a floating component such that the floating component is free to move in a lateral or radial manner relative to the housing within predetermined limits.

The floating component may support cleaning members such as brushes or scraper blades.

The housing may comprise receptive portions that are adapted to receive the floating component and contain the floating component within a predetermined space, the predetermined space being of greater external dimension than the component to a material extent that allows the component to float in a lateral or radial direction with a predetermined degree of freedom. The receptive portions may comprise of one or more female or annular grooves adapted to loosely receive a respective and corresponding male portion on the floating component. Alternatively, the receptive portions may comprise of an inner or outer cylindrical wall about or inside which may be located a corresponding portion of the floating component. Alternatively the receptive portions may comprise of an upper and lower shoulder that are axially spaced apart on and extend radially from a tubular body of the housing, the shoulders confining an annular floating component in an axial direction while the tubular body of the housing limiting the radial floating of the floating component within predetermined limits.

The receptive portions may be formed in or by retaining rings positioned around a body portion of the housing. Preferably, the retaining rings are detachable from the body portion and mounted by bearings on the body portion that allow for relative rotation between the body portion and the retaining rings.

Optionally, the housing comprises of separable upper and lower parts having means for mutual connection, wherein the floating member is provided as a sleeve around the housing and wherein the upper portion and lower portion provide limits to the axial movement of the floating member relative to the housing.

The floating component may be formed as a collet. Alternatively it may be constructed to allow for relative radial movement at both of its axial ends. In the latter case particularly, although not exclusively, the floating component may be constructed for rotational movement relative to the housing. By this, the floating component is able to remain stationary in use, while the housing rotates.

The floating component may be made with an inherent radial resilience. For example, it may be provided with elongated slots running in a substantial axial direction of the floating component that allow the component to be compressed in an inward radial direction. The slots may be angled relative to the longitudinal axis of the housing or drill string to enable coverage of a cleaning member such as bristles or scraper blades to be provided around the full circumference of the tool.

The floating component may be formed as a sleeve or lantern having elongate slots that separate pads supporting cleaning members, wherein the pads may be shaped with differing radii for cleaning more efficiently casing and or liners of differing radii on the same trip. Preferably, the radii of each alternate pad would be the same but different from its adjacent pads.

The tool may include biasing means for biasing all or part of the floating component in an outward radial direction.

In order to provide a better understanding of the invention, example embodiments will now be described with reference to the accompanying figures, in which:

FIGS. 1*a*, 1*b* and 1*c* show three separable components of a down-hole tool in accordance with the invention;

Figure 1A:
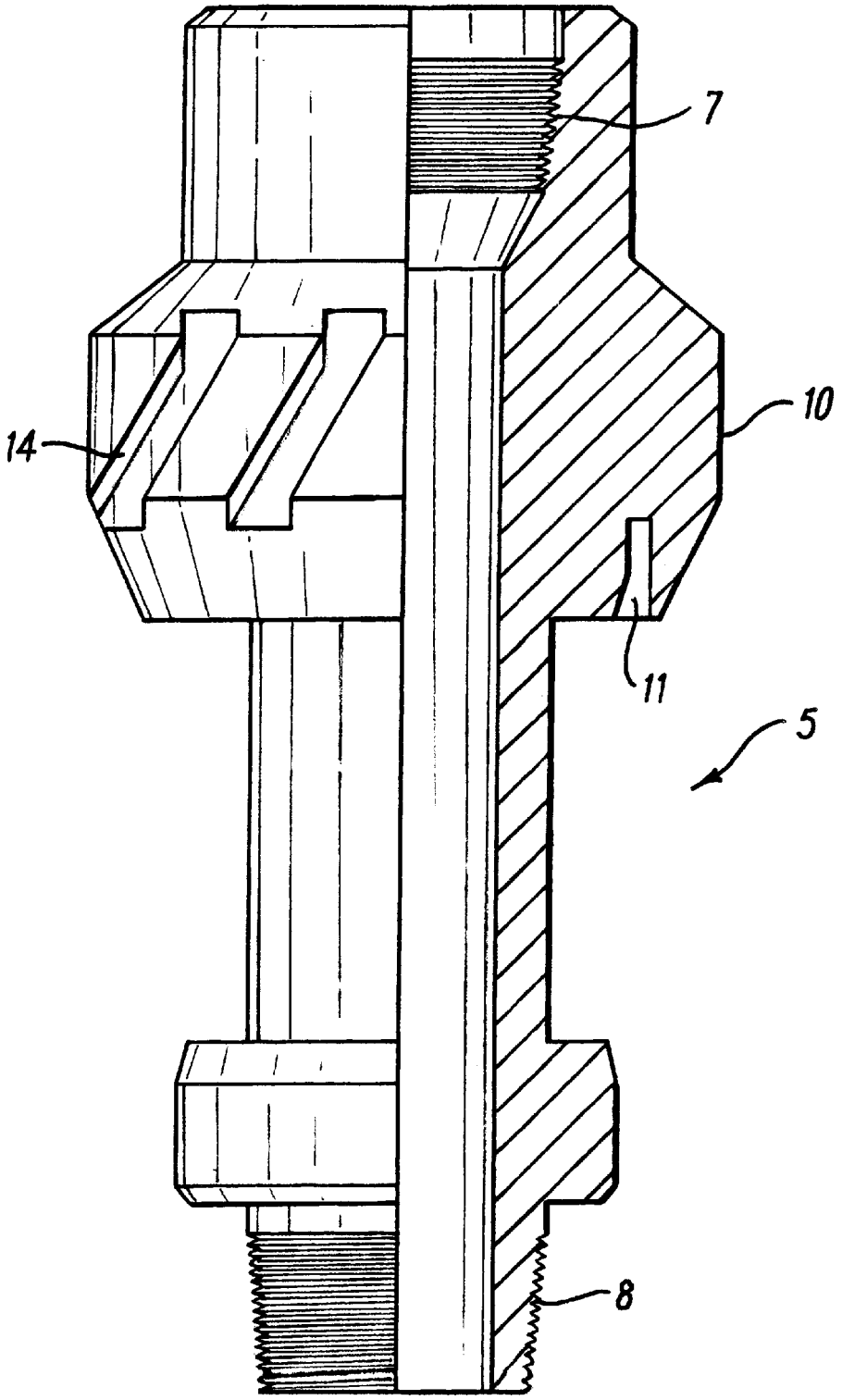
Figure 1B:
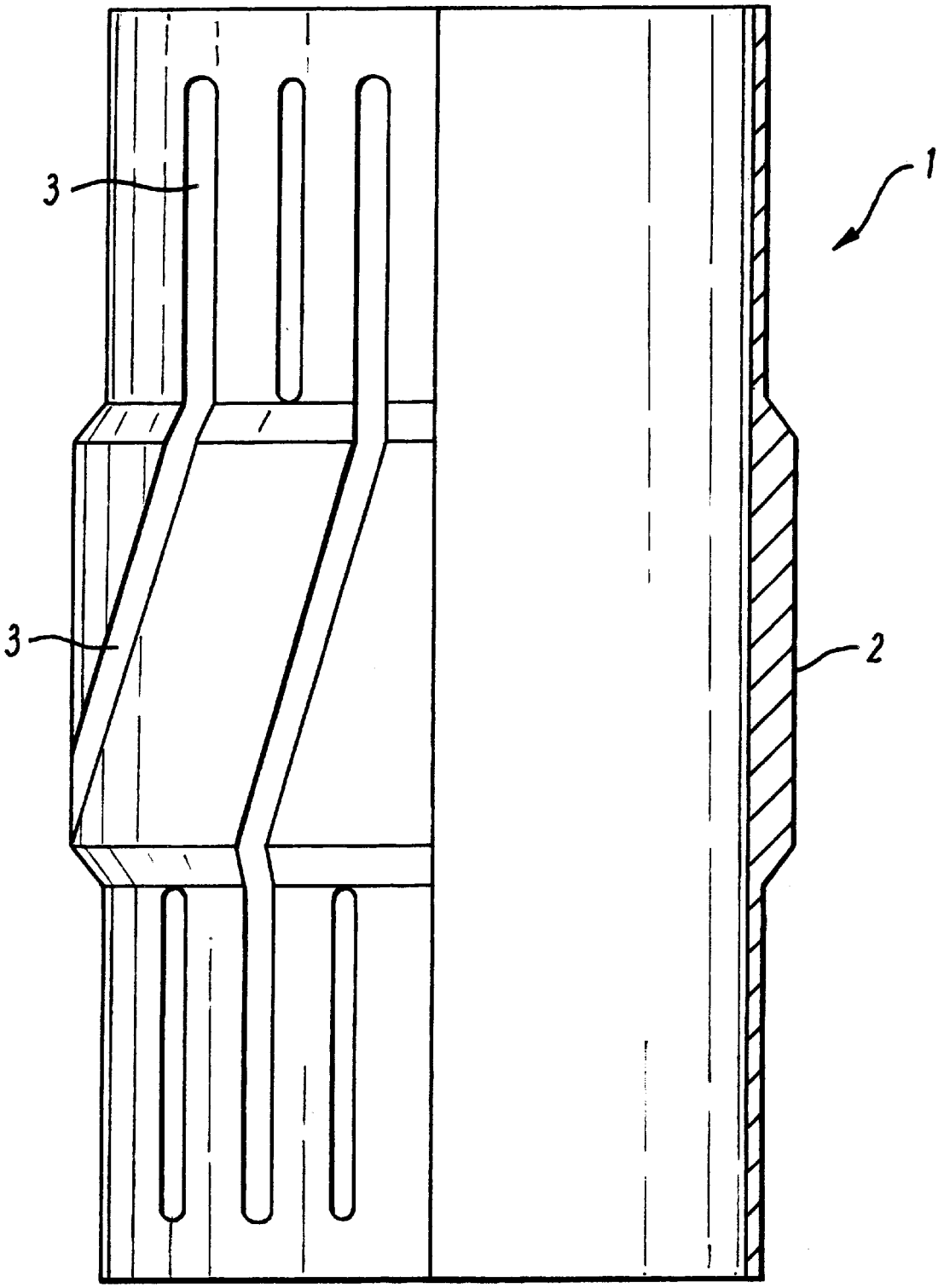

Referring firstly to FIG. 1*b*, a floating component, generally depicted at 1, is provided as a substantially cylindrical lantern having an enlarged belly portion 2 at its mid-section. The lantern 1 is provided with slots 3 that are closed at their axial extremities. It may be seen that the slots 3 are diagonally disposed at the belly portion 2. This allows the belly portion to support cleaning members (not shown) such as bristles covering a full 360 degrees of rotation, while still providing a bypass area to allow for fluid circulation.

In the example shown, the floating lantern 1 is dimensioned to have an outer diameter at its axial extremities of seven inches.

Figure 1C:
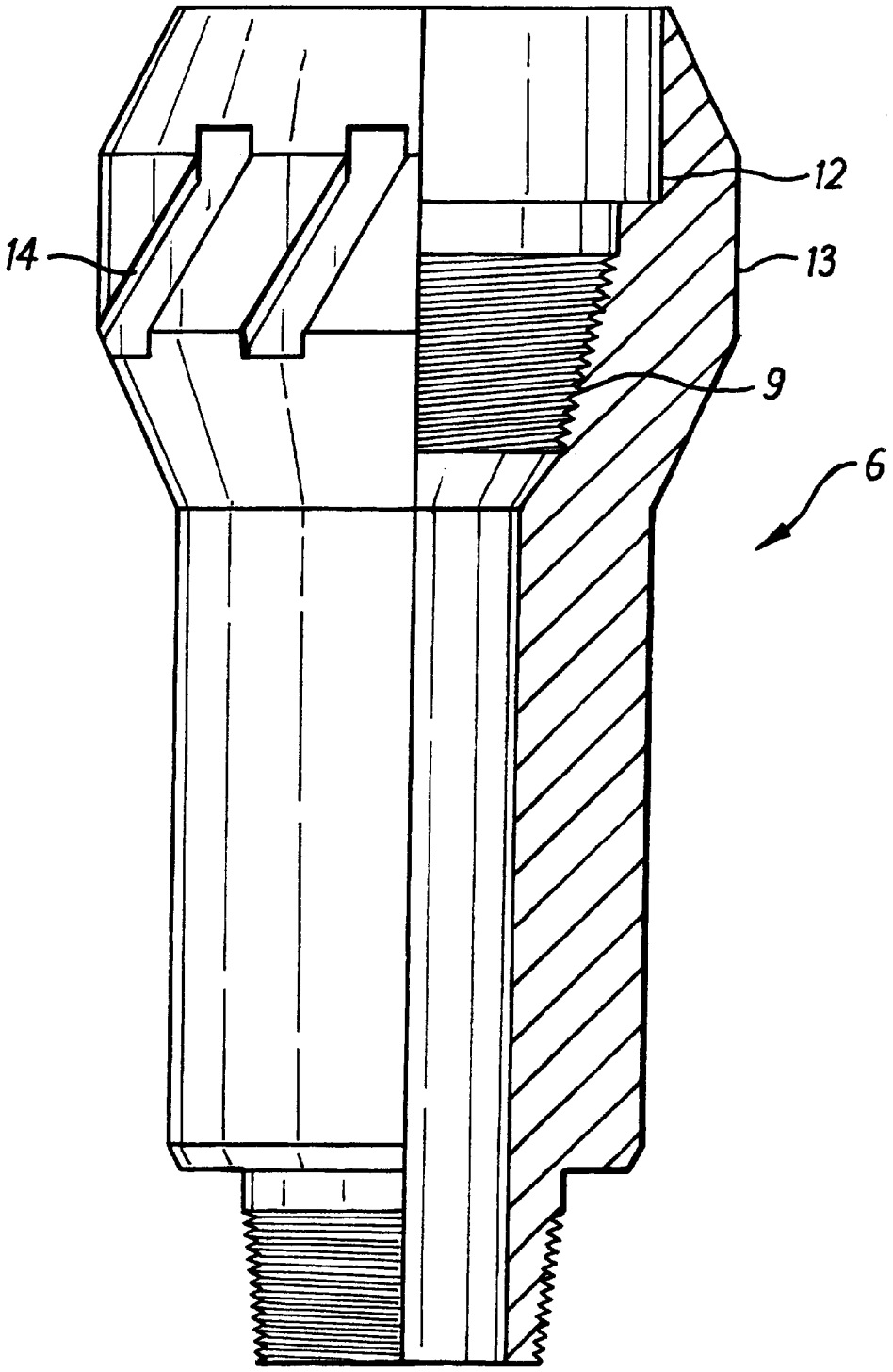

FIGS. 1*a* and 1*c* illustrate a tool housing comprised of an upper portion generally depicted at 5 in FIG. 1*a* and a lower portion generally depicted at 6 in FIG. 1*c*. The upper body 5 of the housing is provided with a threaded internal section 7 for connection to a drill string (not shown) above the tool. The lower axial end of the upper portion 5 has an external thread 8 for connection to a corresponding internal thread 9 in the lower portion 6.

Thus, when assembled the upper and lower portions of the housing are continuous and adapted to bear any axial or torsional load imparted to the string.

The upper portion 5 has an enlarged section 10 having a lower surface that defines an annular receptive portion or recess 11. In the example embodiment illustrated, the recess 11 is two inches deep and five sixteenths of an inch wide. The recess 11 has an internal diameter of 6.50 inches and an outer diameter of 7.125 inches.

When the tool of FIG. 1 is assembled, the floating lantern 1 is located as a sleeve around the axial assembly of the housing. The upper edge of the lantern 1 is fitted in the recess 11 of the upper portions of the housing, while the lower edge of the floating component or lantern 1 rests on the internal shoulder 12 in the lower portion 6.

Consideration of the dimensions of the example embodiment will reveal that the lantern 1 is able to "float" within the limits defined by the housing in a radial or lateral direction. The advantage of this is that the floating lantern 1 is self centralising. Moreover, the force required to centralise the lantern need not be great; it not being necessary to centralise the whole drill string.

Formed in the enlarged portions 10 and 13 of the upper and lower portions 5, 6 of the housing are by-pass channels 14. Typically these channels 14 will be milled into the housing wall.

The slots 3 in the belly of the lantern 1 allow the lantern to have an inherent outward radial bias, in use. More particularly, the belly portion 2 may be sized to be squeezed radially in use by the casing wall; the slots / providing the lantern with an ability to contract as required.

It should be understood herein that the lantern may form part of a wide variety of tools with a diverse range of functions, and the described use as a casing cleaning brush tool herein is given by way of example only.

Figure 2:
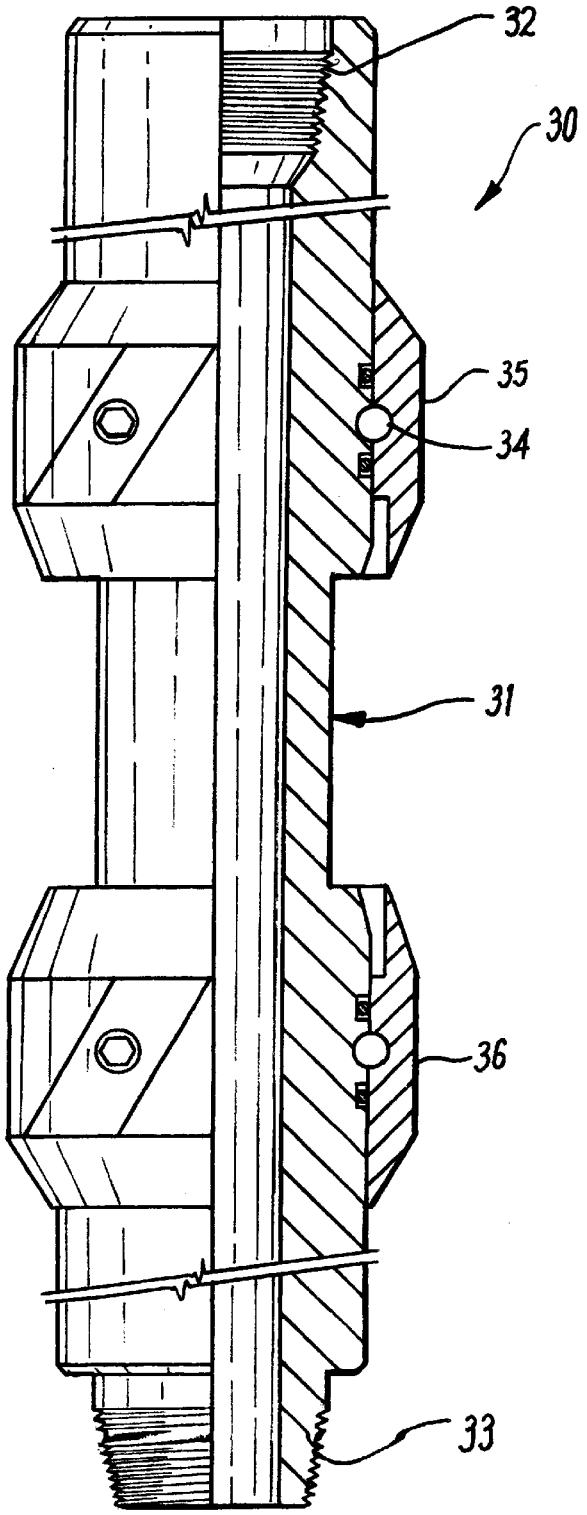
FIGS. 2 and 3 illustrate alternative embodiments of a brushing tool.

Turning now to FIG. 2, an alternative embodiment of tool 30 is shown, albeit with the floating component omitted. The tool 30 has a generally tubular body 31 connectable in a work string by the threaded sections 32 33 at the axial ends of the body 31.

Attached to the body 31 by a bearing connection 34 are upper and lower retaining rings 35, 36. The rings cooperate with the body 31 to provide upper and lower receptive portions for location the floating component (not shown). An advantage of this particular design is that the bearings 34 will help to mitigate casing wear by reason of allowing for the rotation of the body 31 with the work string relative to the retainer rings 35, 36 and floating component.

In an alternative embodiment, the retaining rings may be threaded onto or otherwise detachably fastened to the tubular body of the tool.

Figure 3:
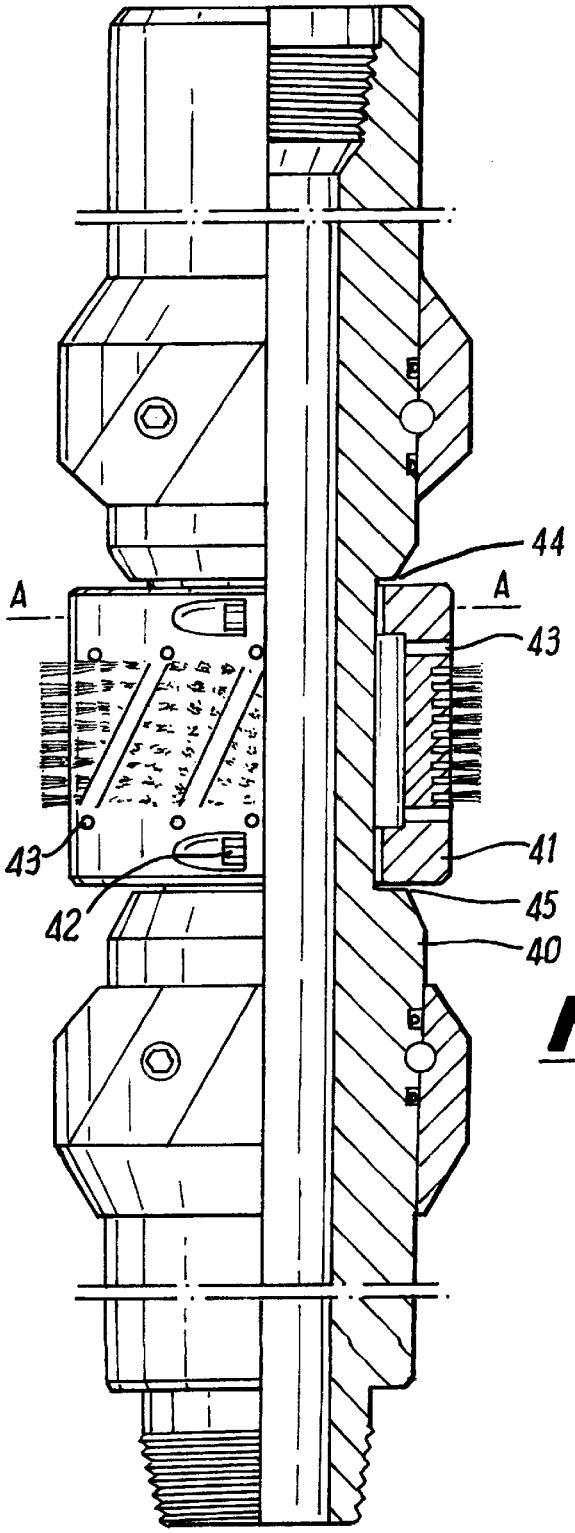

FIG. 3 illustrates a similar brush tool again having an elongate body member 40 supporting a floating component 41. The floating component 41 is provided as a sleeve or/split ring formed from two parts that may be bolted together in use. This may be seen from the view of FIG. 4 hereto. The bolts 42 enable the efficient extraction of the floating component 41 from the housing 40. The shoulders 44, 45 on the housing serve to contain the floating component in an axial direction, while the radial movement of the component 41 is limited, albeit with a degree of freedom, by the tubular body 40 acting on the internal wall of the split ring of the floating component 41. As before, it may be seen that the split ring may rotate relative to the body, thereby reducing wear.

By-pass ports 43 may be generously incorporated into the component 41, as shown.

Figure 4:
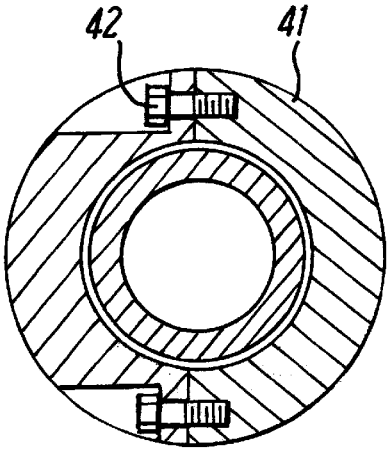
FIG. 4 shows a section through the floating component of FIG. 3.

The design of tool illustrated in FIGS. 3 and 4 is particularly suitable for brush tools of smaller size, such as four and a half inch diameter tools.

Figure 5:
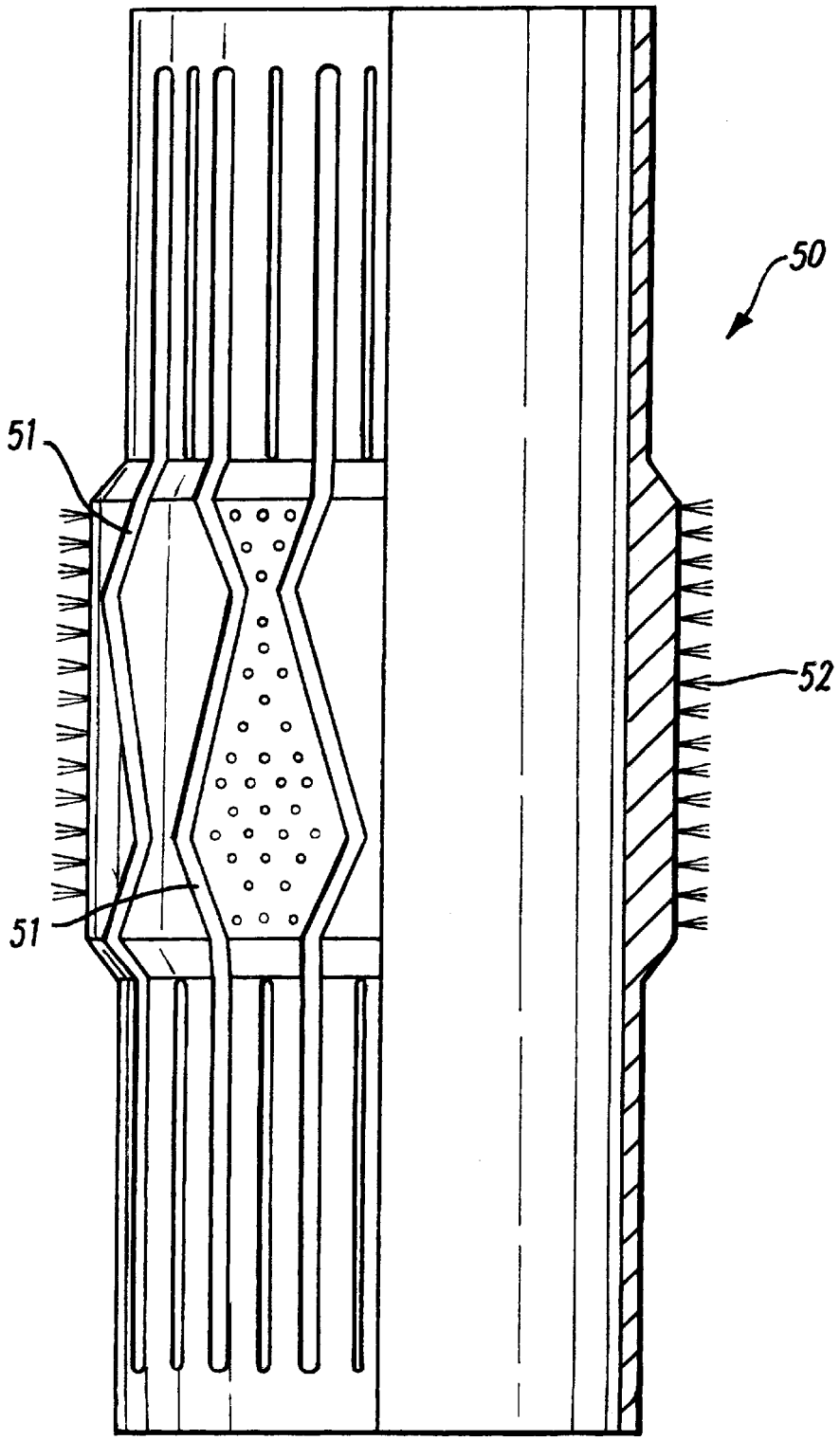
FIG. 5 shows a lantern of alternative design to the lantern illustrated in FIG. 1*b;*

FIG. 5 shows a lantern or floating component 50 of alternative design to the lantern illustrated in FIG. 1*b*; the main difference being in the manner of the slots 51 that are directed in changing diagonal directions, while still allowing for 360 degrees of coverage of the bristles 52.

Figure 6:
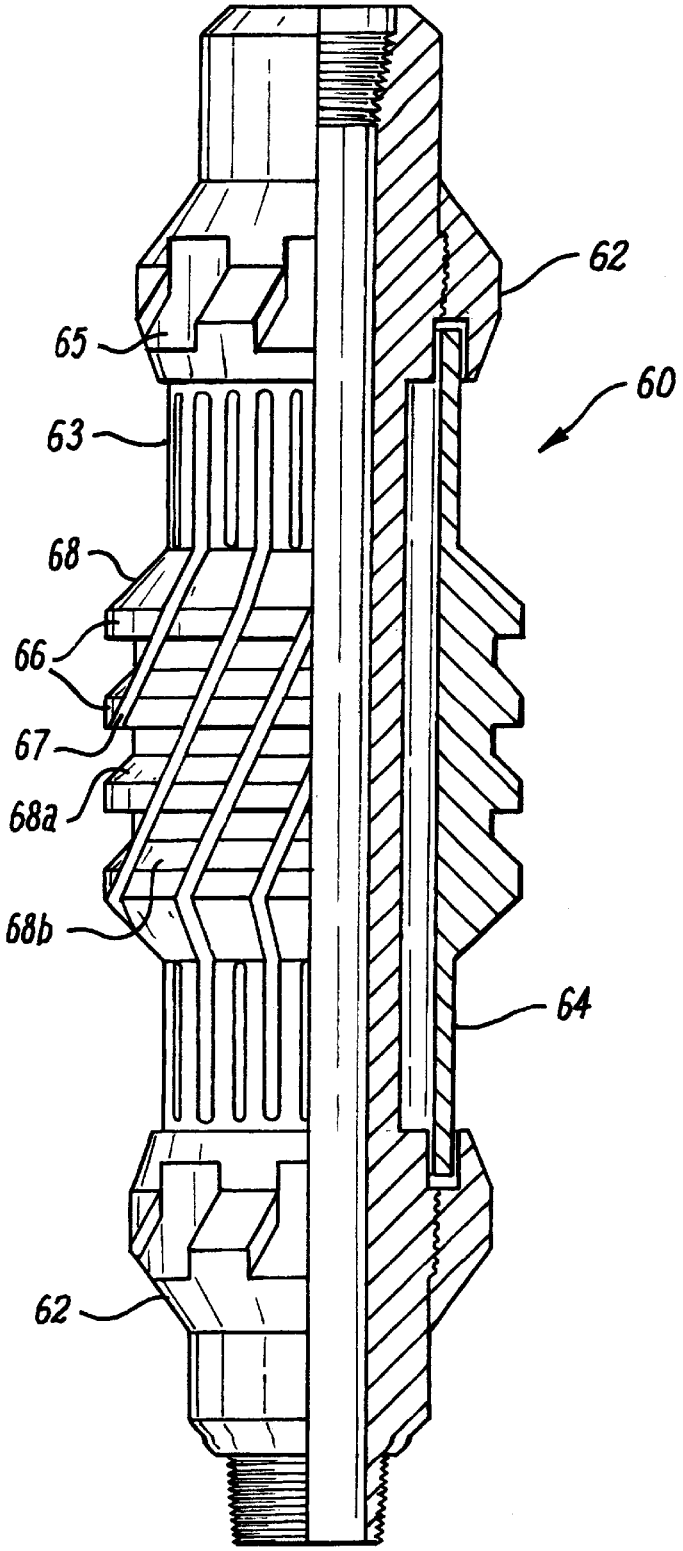
FIG. 6 shows an alternative tool incorporating casing scraper blades.

In FIG. 6 there is depicted a well casing scraper tool 60. The tool 60 is provided with a housing that includes upper and lower retaining rings 62 and a tubular body 63. The retaining rings 62 are threadably engaged with the body 63 and have the dual purpose of acting as centralisers in the casing, while also containing the / floating component 64. The centralising rings 62 are provided with grooves 65 for enabling fluid by-pass.

The floating component 64 is formed as a lantern and supports casing scraper blades 66 mounted on resilient pads 68 separated by diagonal slots 67.

An innovative feature of the tool 60 is found in the machining of the pads 68. In particular, each alternate pad 68*a* may be machined to one outer radius, and the remaining pads 68*b* may be machined to a second outer radius. For example, the pads 68*a* may have an outer diameter of 8.681 inches, while the pads 68*b* may have an outer diameter of 8.535 inches for a nine and five eighths diameter casing tool with a 9 inch outside diameter lantern. In this way the tool will be capable of cleaning two different sizes of casing on the one trip.

Figure 7:
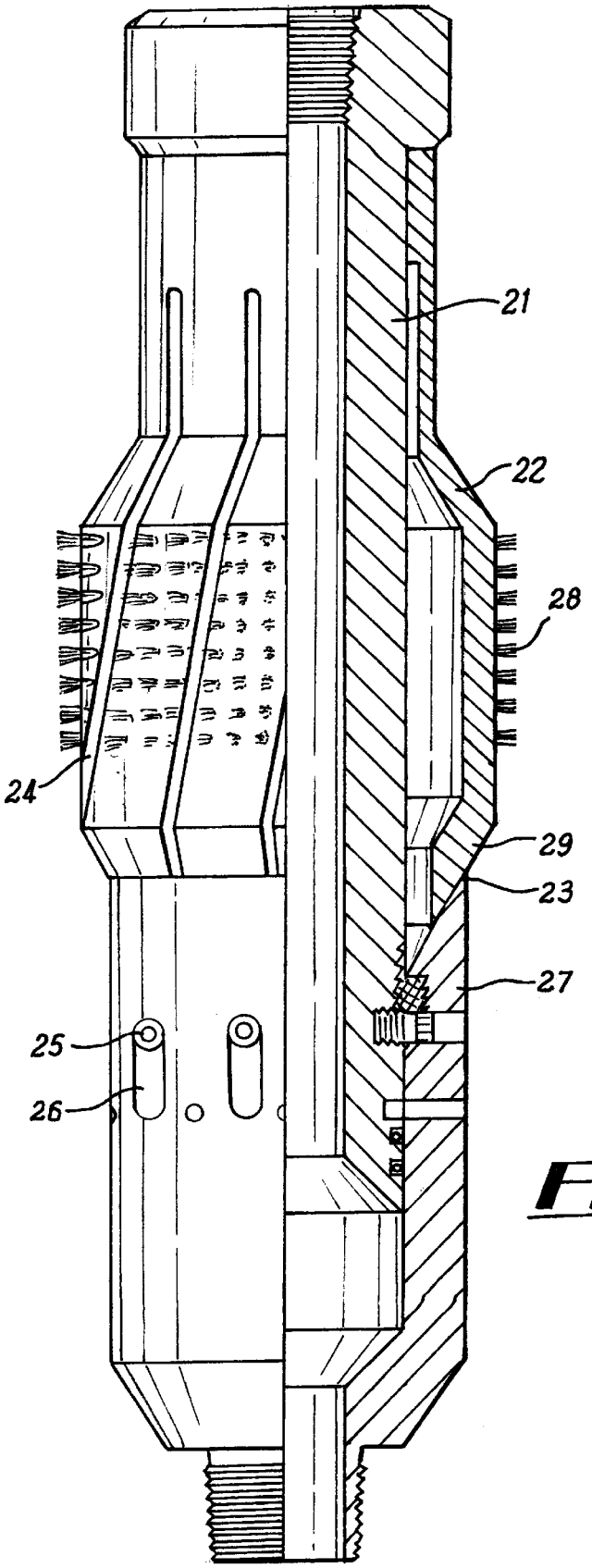
FIG. 7 illustrates a yet further alternative of a tool in accordance with the invention suitable for casing cleanup operations.

A further alternative embodiment of a down-hole tool is shown in FIG. 7. In this example, the tool 20 comprises of a substantially tubular body or housing 21 upon which is supported a collet 22. The collet 22 is fixed to the housing 21 at its upper end but free at its lower end other than being confined by the conical seat 23.

Again the collet 22 may be utilised to bear various cleaning members or other components, but in the Figure is shown to bear bristles 28 for casing cleanup operations.

Also the collet 22 acts as a floating component, although to a lesser extent, with the ability to be self centralising in a casing or other well tubing. This characteristic is enabled by the provision of the slots 24 which are open at the lower or free end of the collet 22, thereby forming fingers that are inherent with an increasing degree of independence toward their extremities.

Although not shown in the Figure, it would be possible to attach the collet 22 to the body 21 via bearings such that the tool body 21 may rotate independently and relative to the collet 22.

In the example embodiment of FIG. 7 means are provided for retracting the collet to enable the bristles to be withdrawn away from contact with the casing wall. The means includes the provision of lugs 25 which extend outwith the body 21 into respective slots 26 formed in sleeve 27. This design allows relative actual movement between the sleeve 27 and the collet 22 such that the conical seat 23 is able to ride up corresponding incline 29 of the collet 22 with the effect that the collet 22 is radially compressed, thereby withdrawing the bristles 23 away from the casing wall. This feature is particularly advantageous when it is desired, for example, to withdraw the tool 20 from the well after a clean up operation and to avoid contact of the bristles 23 on the casing wall in a manner which may dislodge further debris.

In should be appreciated in the invention that it would be possible to provide more than one collet or lantern on any particular tool or drill string. Indeed, a plurality/of floating components could be placed in series along any drill string or tool.

A further advantage of the invention is that the use of resilient collets or lanterns as described in the accompanying examples, negate the requirement for additional springs or the like for creating an outward radial bias. It has been known in the past that small springs can be dislodged from behind pads bearing bristles or scrapers and, once dislodged, the springs can cause damage or inefficiencies in the well.

Moreover, the invention provides for the efficient assembly and disassembly of tool components which may be subject to wear or damage. This is particularly the case as the floating component which is subject of the invention herein is not necessarily secured by mechanical fasteners to the tool body or drill string.

Other advantages will be apparent from the further examination and use of the invention herein described.

Further modifications and improvements may be incorporated without departing from the scope of the invention herein intended.

What is claimed is:

1. A down-hole tool comprising a housing attachable to a work string or drill string, wherein the housing is adapted to support a floating component such that the floating component is free to move in a lateral or radial manner relative to the housing within predetermined limits.

2. A down-hole tool as claimed in claim 1 wherein the floating component supports cleaning members, such as brushes or scraper blades.

3. A down-hole tool as claimed in claim 1 wherein the housing comprises receptive portions that are adapted to receive the floating component and contain the floating component within a predetermined space, the predetermined space being of greater external dimension than the component to a material extent that allows the component to float in a lateral or radial direction with a predetermined degree of freedom.

4. A down-hole tool as claimed in claim 3 wherein the receptive portions comprise of one or more female or annular grooves adapted to loosely receive a respective and corresponding male portion on the floating component.

5. A down-hole tool as claimed in claim 3 wherein the receptive portions comprise of an inner or outer cylindrical wall about or inside which may be located a corresponding portion of the floating component.

6. A down-hole tool as claimed in claim 3 wherein the receptive portions comprise of an upper and lower shoulder that are axially spaced apart on and extend radially from a tubular body of the housing, the shoulders confining an annular floating component in an axial direction while the tubular body of the housing limiting the radial floating of the floating component within predetermined limits.

7. A down-hole tool as claimed in claim 3 wherein the receptive portions are formed in or by retaining rings positioned around a body portion of the housing.

8. A down-hole tool as claimed in claim 7 wherein the retaining rings are detachable from the body portion and mounted by bearings on the body portion that allow for relative rotation between the body portion and the retaining rings.

9. A down-hole tool as claimed in claim 1 wherein the housing comprises of separable upper and lower parts having means for mutual connection, wherein the floating member is provided as a sleeve around the housing and wherein the upper portion and lower portion provide limits to the axial movement of the floating member relative to the housing.

10. A down-hole tool as claimed in claim 1 wherein the floating component is formed as a collet.

11. A down-hole tool as claimed in claim 1 constructed to allow for relative radial movement at both of its axial ends.

12. A down-hole tool as claimed in claim 1 wherein the floating component is constructed for rotational movement relative to the housing.

13. A down-hole tool as claimed in claim 1 wherein the floating component is inherently resilient in a radial direction.

14. A down-hole tool as claimed in claim 13 wherein the floating component is provided with elongated slots running in a substantial axial direction thereof that allow the component to be compressed in an inward radial direction.

15. A down-hole tool as claimed in claim 14 wherein the slots are angled relative to the longitudinal axis of the housing or drill string to enable coverage of a cleaning member such as bristles or scraper blades to be provided around the full circumference of the tool.

16. A down-hole tool as claimed in claim 1 wherein the floating component is formed as a sleeve or lantern having elongate slots that separate pads supporting cleaning members, wherein the pads may be shaped with differing radii for cleaning more efficiently casing and or liners of differing radii on the same trip down hole.

17. A down-hole tool as claimed in claim 16 wherein the radii of each alternate pad is approximately the same but different from its adjacent pads.

18. A down-hole tool as claimed in claim 1 further including biasing means for biasing all or part of the floating component in an outward radial direction.

19. A downhole tool comprising a housing attached to a work string or drill string, wherein the work string or drill string is located inside well casing or liner, and wherein the housing is adapted to support a floating component which is free to move in a lateral or radial manner relative to the housing and the work string or drill string, and which is adapted to be self-centralising within the well casing or liner independent of the position or extent of centralisation of the work string or drill string.

* * * * *

UNITED STATES PATENT AND TRADEMARK OFFICE

CERTIFICATE OF CORRECTION

PATENT NO. : 6,152,220
DATED : November 28, 2000
INVENTOR(S) : Mark Carmichael and Paul Howlett It is certified that error appears in the above-identified patent and that said Letters Patent is hereby corrected as shown below:

Title page,
Following "Inventors:," please change Paul Howlett's address from "Colts" to -- Cults --.

Following "Foreign Application Priority Data," please change "9818181" to -- 9818181.1 --.
Following "Foreign Application Priority Data," please insert -- July 7, 1998 [GB] United Kingdom .....9814651.7 --.

Following "Attorney, Agent or Firm," please change "Woodward" to -- Woodard --.

Signed and Sealed this

Ninth Day of October, 2001

*Attest:*

Nicholas P. Godici

*Attesting Officer*

NICHOLAS P. GODICI
*Acting Director of the United States Patent and Trademark Office*